US005653668A

United States Patent [19]

Wilkinson

[11] Patent Number: 5,653,668

[45] Date of Patent: Aug. 5, 1997

[54] BUTTOCK EXERCISE DEVICE

[76] Inventor: William T. Wilkinson, P.O. Box 73,, Salem, N.J. 08079

[21] Appl. No.: 511,066

[22] Filed: Aug. 3, 1995

[51] Int. Cl.[6] ..... A63B 21/02

[52] U.S. Cl. ..... 482/124; 482/121; 482/126; 482/122

[58] Field of Search ..... 482/121, 122, 482/124, 125, 126

[56] References Cited

U.S. PATENT DOCUMENTS

| | | | |
|---|---|---|---|
| D. 368,501 | 4/1996 | Woodruff . | |
| 554,636 | 2/1896 | Hulsmann . | |
| 1,618,273 | 2/1927 | Davidson | 482/124 |
| 2,097,376 | 10/1937 | Marshman | 482/124 |
| 2,224,103 | 12/1940 | Nilson . | |
| 2,498,006 | 2/1950 | Ridill | 482/124 |
| 3,162,442 | 12/1964 | Karlik | 482/124 |
| 3,966,204 | 6/1976 | Dubach . | |
| 4,023,808 | 5/1977 | Herbert . | |
| 4,033,580 | 7/1977 | Paris . | |
| 4,040,620 | 8/1977 | Friedman . | |
| 4,057,246 | 11/1977 | Wilson . | |
| 4,121,827 | 10/1978 | Weider . | |
| 4,245,840 | 1/1981 | Van Housen . | |
| 4,251,071 | 2/1981 | Norton . | |
| 4,456,249 | 6/1984 | Calabrese | 482/124 |
| 4,565,367 | 1/1986 | Kaiser . | |
| 4,685,671 | 8/1987 | Hagerman et al. | 482/124 |
| 4,889,336 | 12/1989 | Schneiderman | 482/121 |
| 5,318,494 | 6/1994 | Santighian | 482/121 |
| 5,336,151 | 8/1994 | Van Ballegooie | 482/121 |
| 5,433,688 | 7/1995 | Davies . | |

FOREIGN PATENT DOCUMENTS

| | | | |
|---|---|---|---|
| 2263744 | 7/1973 | Germany | 482/121 |

*Primary Examiner*—Lynne A. Reichard
*Attorney, Agent, or Firm*—Connolly & Hutz

[57] ABSTRACT

Thus, the invention lets the user perform a whole group of buttock developing motions, working the muscle from many different angles. These motions are enhanced, through the addition of resistance. The resistance may be varied by adjusting the length of the cords and/or interchanging cords of different elastic strengths. The exercise device has cords and optionally a should and/or neck piece.

5 Claims, 4 Drawing Sheets

BUTTOCK EXERCISE DEVICE

BACKGROUND OF THE INVENTION

One of the largest and most important muscle groups in the body is the rear end or buttock. This muscle is also one of the hardest to tone, strengthen and shape.

It would be highly desirable to have a convenience, low impact, compact, portable and economical device that would allow the user to quickly develop and condition this muscle group. To date, most equipment has been big, expensive health club machines.

SUMMARY OF THE INVENTION

An object of this invention is to capture all of the above features and help the user to do a number of key exercises, utilizing resistance that specifically work the hind quarters, thus producing a superior buttock workout. The invention enhances these key buttock developing exercises by providing added resistance throughout the motion.

Among the highly desirable buttock developing exercises that are improved by the use of the invention are:

1) Squats/knee bends;
2) Standing bent leg lifts/raises;
3) Toe raises and heel leg rotation;
4) Bent leg lifts, lying down
5) Bent leg push downs, lying down;
6) Backward and upward leg thrusts, on hands and knees;
7) Inward and outward leg scissors in the sitting positions.

DESCRIPTION OF THE PREFERRED EMBODIMENT

Figure 1:
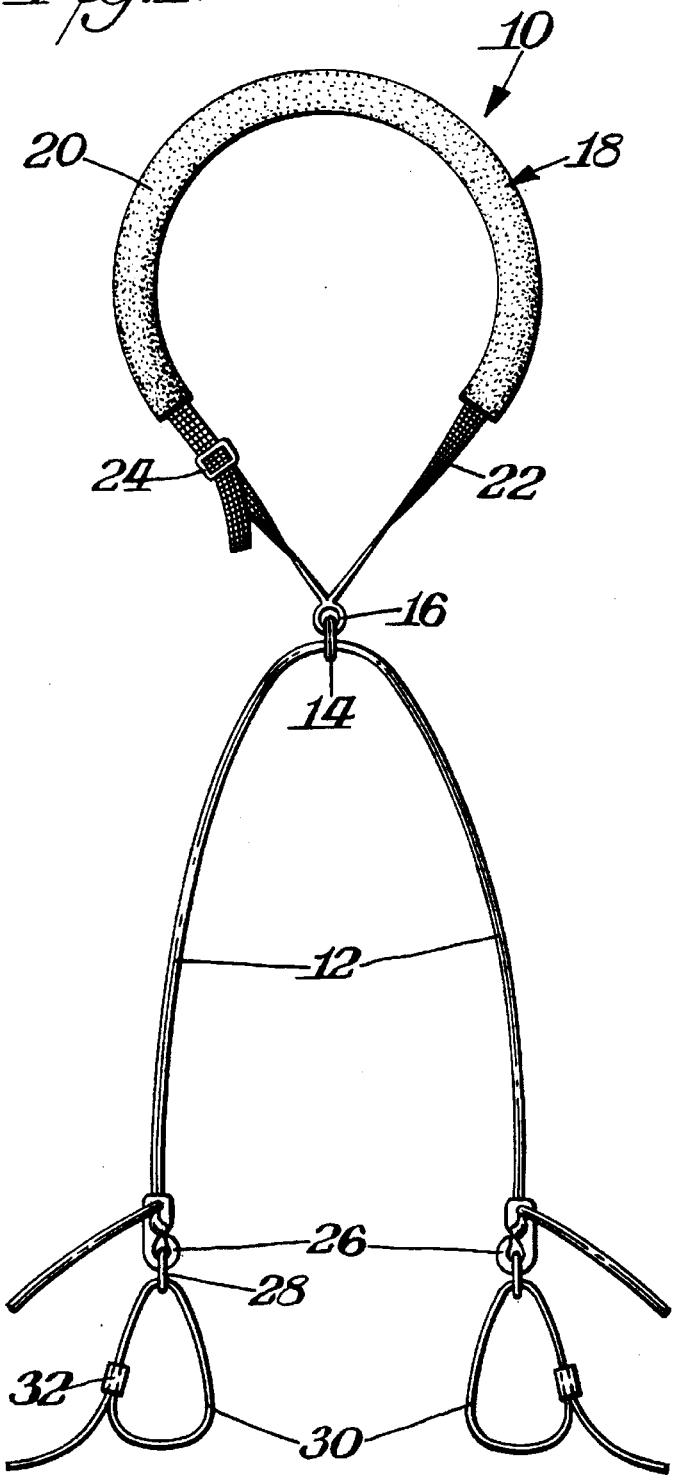
FIG. 1 is a front elevational view of the buttock exercise device according to this invention.

FIG. 1 shows a from elevational view of an exercise device 10 of this invention. The exercise device 10 according to this invention has a band or cord 12 which can be of various lengths or strengths and also varying degrees of elasticity. The cord 12 can be attached to an attachment means such as, but not limited to, a ring 14. The cord can be permanently attached or detachable or even attached so that cord 12 can move freely. In the preferred embodiment, the attachment means would allow the cord 12 to move freely. The inside diameter of the ring 14 would be greater than the outside diameter of the cord 12, thereby enabling the cord 12 to move freely inside the ring 14. A collar or neck piece 18 can be connected to the ring 14 by any attachment means such as, but not limited to, a connector loop 16. The collar or neck piece 18 can be padded 20 as shown in FIG. 1. In addition, instead of a collar or neck piece 18, suspenders, or a harness going over the chest and across the back can be used as discussed below. Also a belt or vest configuration can be used as discussed below. The neck piece 18 can be made of any material such as, but not limited to a fabric, web or mesh material. The neck piece 18 can be adjustable in size. The adjustable means can be any conventional adjustment means, such as, but is not limited to, a strap 22 and buckle 24 combination. The neck piece 18 can also be made of web strap 22 or can be made of absorbing material such as, but not limited to a foam 20. The web adjustment strap 22 can be at least one piece. The strap 22 can be non-adjustable by being only one piece. The strap 22 can go completely around and have foam 20 or other soft absorbing material on top of it for the sake of comfort and preventing injury to the neck, or it can be attached to the end of the foam 20. There can be an adjustment means such as, but not limited to, a snap, clip or buckle 24. This way the user can adjust the inner diameter of the neck piece 18 to the desired diameter by pulling the strap 22 through the buckle 24.

The ring 14 does not have to be present. The cord 12 can also be connected to strap 22 without the use of the ring 14. It is also possible that both the ring 14 and the strap 22 are not present. In addition, the cord can proceed around the user's neck or proceed through the neck piece 18.

Additionally, there can be a foot attachment means such as, but not limited to a foot harness, ankle harness, loop or stirrup 30 that can be connected to the cord 12. The stirrup 30 can be made of any material, such as, but not limited to, a web material, metal, plastic, elastic or the like. The stirrup 30 can be adjustable or non-adjustable. If the stirrup 30 is adjustable, there can be adjustment means such as, but not limited to snaps, hook and loop fastening tape known as VELCRO®, clips or a buckle 32. The material of the stirrup 30 can be pulled through the adjustment means 32 to decrease the diameter of the stirrup 30. If the user wants to enlarge the diameter of the stirrup 30 the material can be pushed the opposite direction through the adjustment means 32 thereby enlarging the diameter of the stirrup 30. The stirrup 30 can be permanently attached to the cord 12 or the stirrup 30 can be detachable connected to the cord 12. If the stirrup 30 is detachable, it can additionally have an attachment means such as, but not limited to, clips, snaps, VELCRO® or a ring 28 as shown in FIG. 1. There could be an attachment means 26 which can attach the stirrup 30 to the exercise cord 12. The attachment means 26 can be, but is not limited to a tube clamp or a clip. This attachment means 26 can also function as an adjustment means for the length of the cord 12. The tube clamp or clip 26 would be capable of adjusting the length of the cord 12 besides connecting the stirrup 30 to the cord 12. The cord 12 can be shorten or lengthen depending on the size of the user and the type of exercise. To shorten the cord 12, the cord 12 is pulled through the adjustment means 26. To lengthen the cord 12 the reverse is done.

Figure 2:
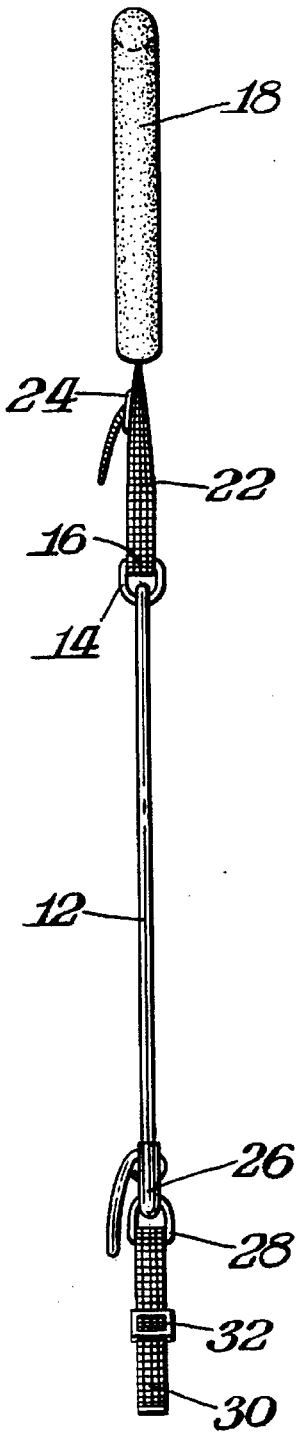
FIG. 2 shows a side elevational view of the exercise device according to this invention.

FIG. 2 shows a side elevational view of the device as shown in FIG. 1. The neck piece 18 and foam piece 20 are shown in a tubular form. Advertising may optionally be placed on the foam piece. The neck piece 18 and foam piece 20 can be connected to the web strap 22. The web strap 22 can be connected to a ring 14. The web strap adjustment 22 is able to move freely along the ring 14. In addition, the device can have different length cords 12 to perform different exercises. It is also possible that the cord 12 is adjustable in length as shown in FIG. 1. They can also be non-adjustable cords 12 of different lengths used.

Figure 3:
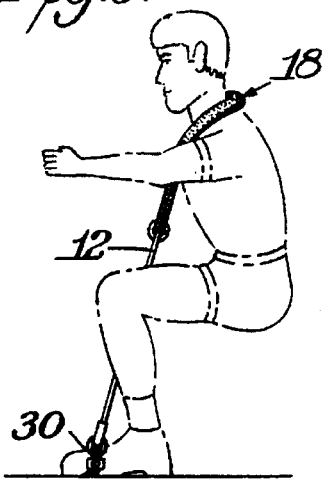
FIG. 3 shows a schematic view showing squatting/knee bend exercises while using the exercise device according to this invention.

FIG. 3 shows a schematic view showing a user performing squatting and knee bends with the exercise device according to this invention. The user places his head inside the neck piece 18 and then if the user is using an adjustable neck piece 18, the user can adjust the neck piece 18 to the desired size so that neck piece 18 fits comfortably around the user's neck. The user then could place the user's feet inside the stirrups 30. The user could adjust the stirrups 30 to the desired position so that they fit snugly around the user's feet. The user can also adjust the tension in the cord 12 to vary the degree of the workout. The cords 12 come across the chest where they are joined by a clip to prevent them from slipping off. The user can then perform knee bends by starting in the standing up or erect position (rest position) and then squatting down by bending the user's knees. The ideal way to perform the knee bends is to keep the back straight while moving the body downwardly in the squat position. The user can stay in that position for any length of time such as but not limited to about 1 to about 10 seconds and then return back to the upright position (rest position). The user can place the user's hands on the user's knees to give extra balance. The user would then begin performing his exercise and doing as many repetitions as is desired. The exercise would end up strengthening, shaping and toning the user's buttock. The user can also place weights or heavy objects on the user's shoulders to create more resistance. The user can also perform this exercise while using a commercially available squatting machine that applies weight to the user's shoulders when the user pushes from the bent knee position to the erect (completely straight) position.

Figure 4:
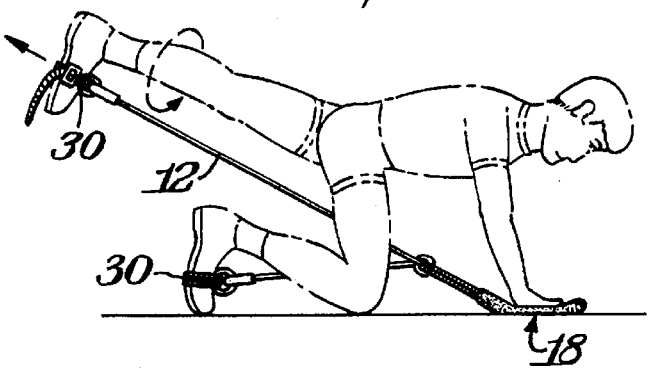
FIG. 4 shows a schematic view showing leg thrusts exercises while using the exercise device according to this invention.

FIG. 4 shows a schematic view showing the user performing leg thrusts with the device according to this invention. The user starts the exercise down on the user's hands and knees on the ground surface as shown in FIG. 4. The user places one foot or optionally both feet inside a stirrup 30. The user could then place one hand on the cord 12 or neck piece 18 or foam piece 20. If additional resistance is desired, the user can shorten the cord 12 or grab a portion of the cord 12 with the user's hands to create more tension in the cord 12 and thereby creating more resistance. Again, the other foot of the user can either be in the stirrup 30 or outside the stirrup 30. The user would have the user's knee and foot of the other leg (not in the stirrup or not being used for the first leg thrust) touching the ground surface. The user could then thrust the leg that has the foot inside the stirrup 30 straight back or back at an angle placing the leg above the plane of the user's back. Upon full extension, the user can hold his leg in that position for any length of time such as, but not limited to, about 1 to about 10 seconds and then return the user's leg back to the rest position (the position the user is initially at when the exercise begins, both hands, knees and feet on the ground surface). The user could also rotate the leg while thrusting the leg or rotate the leg while the leg is fully extended. The user can have each foot in a different stirrup 30. The user can perform the exercise as described above, but alternately thrusting the left and right legs until the user achieves the desired result.

Figure 5:
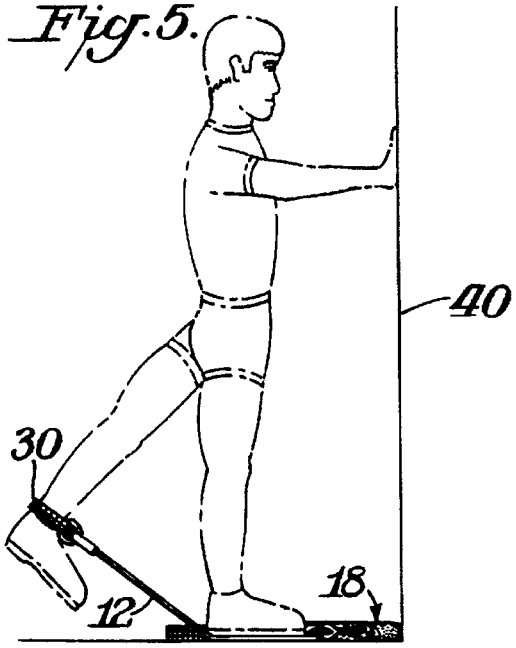
FIG. 5 shows a schematic view showing leg raise exercises while using the exercise device according to this invention.

FIG. 5 shows a schematic view showing the user performing leg raises with the device according to this invention. The user places one stirrup 30 around the user's ankle. With the other foot (the weight bearing foot), the user stands either on the cord 12 or on the top of the device 10, such as on the neck piece 18. The non-weight bearing leg is then lifted upward against resistance to create the exercise. Alternatively, the cord 12 can be anchored under a door, or to a piece of heaving furniture. To get a more full, circular range of motion, the user would have the leg extended back, as it begins to pull against resistance.

Alternatively, the user stands in front of a surface such as, but not limited to, a doorway, piece of furniture (for balance) or a wall 40 or other surface that the user can push off of. The user then pulls back on the user's leg, thereby causing tension to form in the cord 12. The user can adjust the length of the cord 12 so that the desired amount of tension is in the cord 12. The user holds the user's leg extended for a period of time such as, but not limited to, about 1 to about 10 seconds, preferably at least about 5 seconds, then the user allows his foot to go into a relaxed position (back to the original position). The user pulls the leg back again and does as many repetitions as is desired. The user can also rotate his leg while pulling the leg back or while the leg is fully extended. The user can also attach both stirrups 30 around each of the user's ankles. The user can also rotate and pull back one leg at a time, pulling back first on one leg, while extending the other leg for the desired time and then bringing it back to the rest position and pulling back on the other leg, extending it for the desired time, then bringing that back to the rest position. The user could also pull back first on one leg and extend the leg for the desired time and while the first leg is extended, pull back on the other leg, extending the second leg for the desired time. Then, the user can bring the first leg back to the rest position and then bring the second leg back to the rest position.

It is also possible for the user to place one end of the cord 12 under the heel of his standing foot, thereby anchoring it. He would lift his other leg (the leg that is in the stirrup 30) upward, against the elastic resistance. The user could the leg in that position for the desired period of time and then bring the leg back to the rest position (on the ground surface).

It is also possible for the user to perform leg lifts by standing in the vertical position (the user standing upright) (rest position). The starting position is shown in FIG. 5 with the user's leg is in the stirrup 30 either behind the user or on the ground surface. The user extends the user's leg upward in front of the user thereby causing more tension in the cord 12. The user then brings the user's leg back to the rest position.

Figure 6:
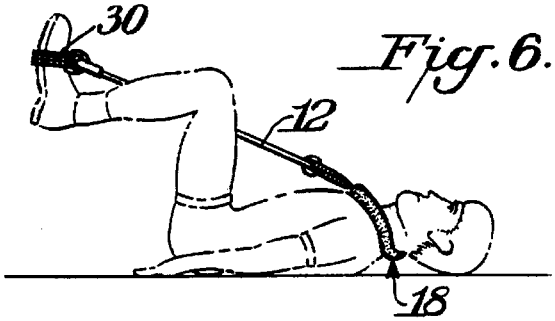
FIG. 6 shows a schematic view showing bent leg lift exercises while using the exercise device according to this invention.

FIG. 6 shows a schematic view showing the user performing bent leg presses with the device according to this invention. The user lies with the user's back on a ground surface. The user would place the stirrup 30 around one foot. The user would also place the neck piece 18 around the user's neck. The user bends at his trunk, so that his knees would be perpendicular to the ground surface and his upper leg would be parallel to the ground surface. The user then extends his leg out to lock it into position, thereby causing tension on the cord 12. The user would repeat this series of exercises until the user received the desired workout. The user can also attach one stirrup 30 to each foot and perform the same exercise. The user thereby would be able to extend one leg at a time or extend both legs at the same time causing tension to be pulled on the cord 12. The foam neck piece 20 would prevent the user from hurting his neck during the exercise.

Figure 7:
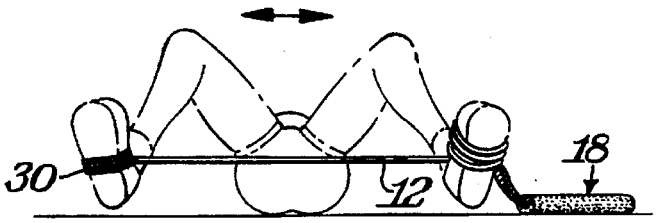
FIG. 7 shows a schematic view showing outward leg spreads while using the exercise device according to this invention.

FIG. 7 shows a schematic view showing the user performing inward and outward leg spreads (or sometimes referred to as leg scissors) with the exercise device according to this invention. The user would place one foot into the stirrup 30. The user then could wrap the cord 12 around the user's other foot. Depending how many times the user wraps the cord 12 around the leg will dictate the amount of tension on the cord 12. The more times the user wraps the cord 12 around the user's foot the greater the tension in the cord 12 and the greater the resistance created during the exercise. The user would lie on his back with his knees bent facing upward. The user then would spread or push the user's legs, outwardly or away from each other thereby causing greater tension on the cord 12. Then the user would bring the user's legs together thereby going back to the rest position and decreasing the tension in the cord 12. The user would repeat this exercise until the user received the desired results. It is also possible for the user to place each foot in a stirrup 30. The user could use a short cord 12 or adjust the length of the cord 12. The user would then spread or push the user's legs in apart to create a strong resistance and a greater tension in the cord 12. Then the user would bring the legs together to decrease the resistance and return back to the rest position.

The exercise can be performed by the user resting on the user's arms that are extended by the side of the user, and are placed slightly behind the user's back. The cords 12 can then be looped around the legs, and provide resistance when the legs are extended and moved in an outward direction. Alternately, the cord 12 can be attached to the stirrup 30 and then attached to the legs of a sofa or table. The user then brings his spread legs together, working against the elastic resistance as described above.

Figure 8:
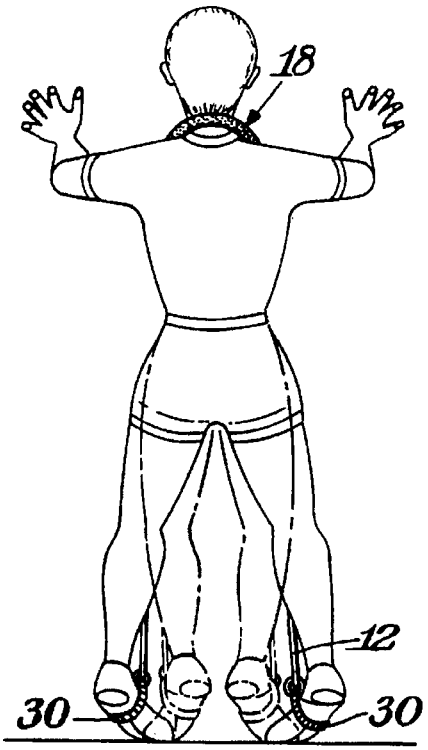
FIG. 8 shows a schematic view showing toe raise exercises while using the exercise device according to this invention.

FIG. 8 shows a top plan view of toe raise exercises while using the device according to this invention. The user places the neck piece 18 around the user's neck. The user then places the user's feet inside the stirrups 30. The user then raises the user's heels and stands on the user's toe thereby causing more tension on the cord 12. The user stands in that position for the desired time period. The user then can rotate his feet inwardly and hold it for the desired time period and then rotate his feet outwardly for the desired time period. The user can rest by placing the user's heels back on the ground, however, the user does not have to do that. The user can also stand on his toes or stand if pigeon-toed direction pointing the toes inwardly and then move the toes outwardly. The neck piece 18 would provide more comfort during the workup.

Figure 8B:
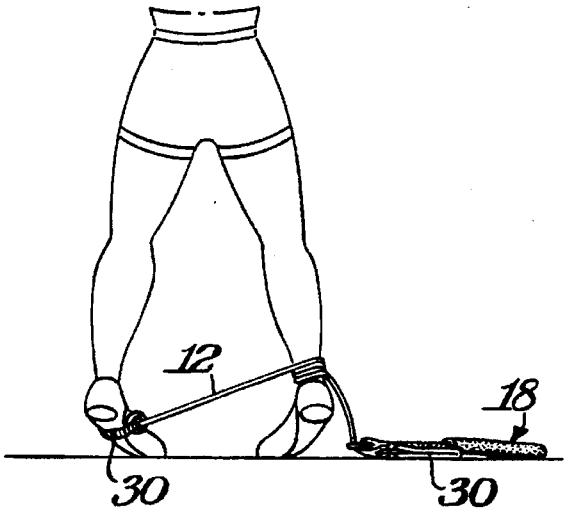
FIG. 8B shows a schematic view showing toe raise exercises while using the exercise device according to this invention.
Figure 8A:
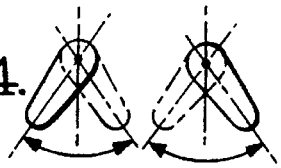
FIG. 8A shows a top plan view of foot placement for the exercise shown in FIG. 8.

FIG. 8*a* shows a top plan view of the foot placement for the exercise shown in FIG. 8 and 8*b*. The ball of the user's foot can be the pivot point. The user can stand on his toes and face them inwardly and hold it for a time period then the user can pivot on the ball of his foot and change the position of the toes by having the toes face outwardly. The user could then put the weight on his toes by raising the user's heels for the desired time period. The user can do a series of these exercises until the user gets the desired result. When the user raises the user's heels off the ground and stands on the user's toes the tension in the cord 12 would increase when the user goes to the rest position and places the user's heels on the ground, the tension in the cord 12 would decrease.

FIG. 8*b* shows toe raise exercises while using the exercise device according to this invention. This exercise is the same as described in FIG. 8 above but uses the exercise devise slightly different. The user places the stirrup 30 around on of the user's feet. The user then wraps the cord 12 around the other leg's ankle. The user stands on the user's toes and raises the user's heels off the ground. The user then can rotate the user's toes inwardly while keeping the heels raised and hold for a desired time period and then rotate the user's toes outwardly and hold for a desired time period. The user can also stand on his toes or stand in a "pigeon-toed" direction pointing the toes inwardly and/or outwardly. The user can repeat this exercise until the user has achieved the desired result. This exercise will also help develop the buttocks.

Figure 9:
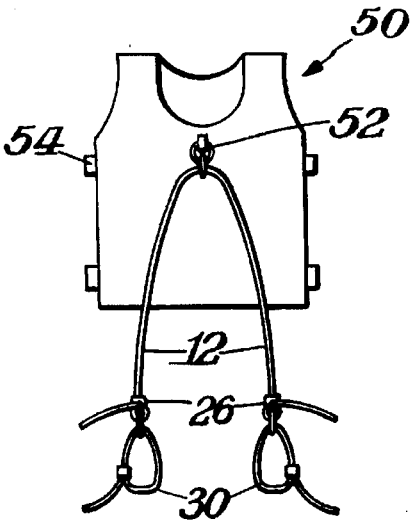
FIG. 9 shows a front elevational view of a vest with the exercise device attached according to this invention.

FIG. 9 shows another exercise device according to this invention. The cord 12 can be attached to a vest 50 by an attachment means 52. The attachment means 52 can be, but is not limited to, a ring, snap, buckle, clamp or clip. The cord 12 can be permanently or detachably attached to the vest 50. The vest 50 can be any conventional type of vest. The cord 12 can also be in an attached fixed position so that it does not move or can be attached in a manner that the diameter of the cord 12 is smaller than the diameter of the attachment means 52 thereby allowing the cord 12 to move freely. The vest 50 can have adjustment means 54 thereby enabling the user to tighten or loosen the vest 50. The vest 50 can be adjusted to fit a variety of different users. Connected to the cord 12 can be stirrups 30. The stirrups 30 can have an adjustment means 32 as described in FIG. 1. The cord 12 can also be adjustable by and adjustment means 26 as shown and described in FIG. 1. The user would wear the vest 50. The cord 12 can be attached either to the front or to the back of the vest 50, and preferably, it is attached to the front of the vest 50. The vest 50 can have an opening in the front or in the sides to allow the user to get into it easier. It is also possible that the vest 50 does not have any openings except for the head and the arms and the user just pulls the vest over the user's head to put the vest 50 on. Once in place, the user can perform the exercises as described above.

Figure 10:
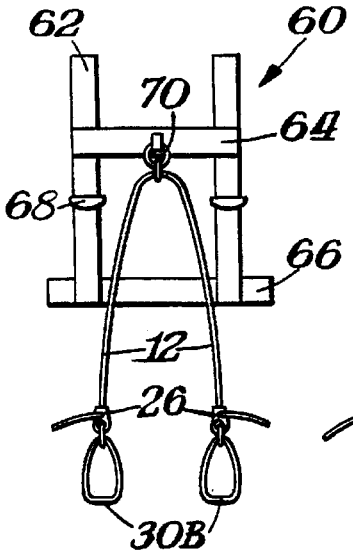
FIG. 10 shows a front elevational view of a body harness according to this invention.

FIG. 10 shows another embodiment according to this invention. In FIG. 10 the cord 12 can be connected to a body harness 60. The body harness 60 could be designed so that the harness 60 would go over the shoulders of a user by a means such as, but not limited to, loops 62. The loops 62 can be connected by an attachment means 64 to stabilize the loops 62, such as but not limited to, a chest band 64. The loops 62 would go over the shoulder and can be connected to a waist strap 66. The waist strap 66 can be adjustable so that it can fit different size people. The loop 62 can also have an adjustment means such as a clip 68 as shown in FIG. 10. There could be a fastening means 70 to attach the cord 12 to the harness 60. Non-adjustable stirrups 30B can be attached to the cord 12. This can be done by an attachment means such as but not limited to 26 as described in FIG. 1 above. The stirrups 30B can be made of any material but preferably a material that can expand or contract such as, but not limited to, elastic so that it can fit a variety of different sized feet. The foot would go inside the stirrup 30B and the material of the stirrup 30B would stretch thereby allowing the user to fit the user's feet inside the stirrups 30B. The user can then place the user's feet inside the stirrups 30B as described above and place the harness 60 around the user's shoulders and the adjustable waist strap 66 around the user's waist. Once in place, the user can perform the exercises as described above.

Figure 11:
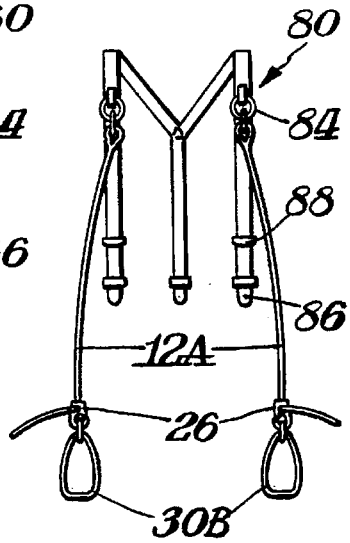
FIG. 11 shows a front elevational view of suspenders with the exercise device according to this invention attached.

FIG. 11 shows another embodiment according to this invention. FIG. 11, shows at least one cord 12A attached to suspenders 80. The cords 12A would be identical to the cord 12 described above. The suspenders may be of any conventional type suspenders. The cord 12A may be attached by an attachment means such as, but not limited to clips, rings, snaps, or even permanently attached such as, but not limited to, sewn into the suspender strap 86. In FIG. 11 it is shown that the attachment means 84 is a ring. The suspenders 80 can have an attachment means such as, but not limited to, clips 88 fastened to the user's pants. The suspenders may also have adjustment means 88 that allows the suspenders 80 to be adjustable to fit a different number of users. Also attached to the cord 12A can be stirrups 30 adjustable or non-adjustable. Non-adjustable stirrups 30B are shown in FIG. 11. They can be attached by any means such as, but not limited to, attachment means 26 as described in FIG. 1 above. The user could wear the suspenders 80 and adjust them to the desired position and then the user can attach the elastic cord 12A to the suspender 80. The user can attach one or two cords 12A to the suspenders 80. It is alto possible to have the cords 12A permanently attached to the suspenders strap 86. Once in place, the user can perform the exercises as described above.

Figure 12:
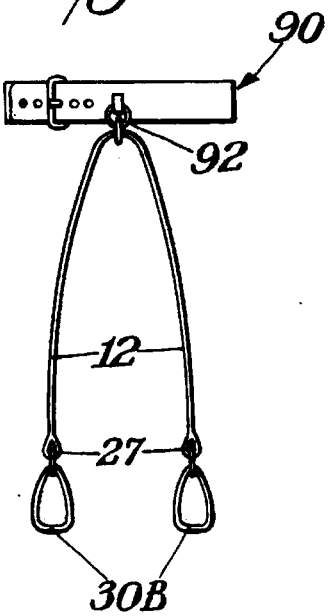
FIG. 12 shows a front elevational view of another embodiment of the exercise device according to this invention.

FIG. 12 shows another embodiment according to this invention. FIG. 12 shows a cord 12 attached to a belt 90. The belt 90 can have an attachment means 92 that allows the cord 12 to be attached to it. As described above, there could be non-adjustable attachment means 27 that attaches the stirrups 30B to the cord 12. The non-adjustable attachment means 27 can be, but is not limited to clips, snaps, VELCRO® or a ring. The non-adjustable attachment means could be attached to each end of cord 12. It is also possible to have the end of the cord 12 form a loop and have the loop connected to the stirrups 30B. The user would be able to adjust the belt to the desired position. Once in place, the user can perform the exercises as described above.

Obviously, this invention can be practiced as being completely adjustable or partially adjustable or not adjustable as described above. While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

I claim:

1. A method of exercising the buttock of a user comprising the user employing an exercise device comprising:

a) at least one elastic cord having two ends, b) at least one foot attachment said foot attachment is of a size and shape to allow a user to insert a foot into said foot attachment and c) at least one attachment means which attaches said foot attachment means to said elastic cord and said user places the foot attachment around at least one of said ankles and said user stands on said exercise device, the user, in a standing position, pulls back the leg with said foot attachment around said ankle and holds the leg for a period of time and then the user brings the leg back to the original position.

2. A method of exercising the buttock of a user comprising the user employing an exercise device comprising:

a) at least one elastic cord having two ends, b) at least one foot attachment, said foot attachment means is of a size and shape to allow a user to insert a foot into said foot attachment and c) at least one attachment means which attaches said foot attachment means to said elastic cord and said user places each foot in said foot attachment and the user places the user's hands on the exercise device, the user is in the rest position when the user has both knees, both feet and both hands on the ground surface and the user's back is parallel to the ground surface, the user then thrusts one leg backward until it is fully extended, the user optionally can rotate the leg when the leg is being thrusted backwards or when the leg is fully extended, the user then brings the leg back to the rest position, the user can optionally then trust the other leg and hold it and then bring it back to the rest position.

3. A method of exercising the buttock of a user comprising the user employing an exercise device comprising:

a) at least one elastic cord having two ends, b) at least one foot attachment, said foot attachment means is of a size and shape to allow a user to insert a foot into said foot attachment and c) at least one attachment means which attaches said foot attachment means to said elastic cord and said user inserts one foot in said foot attachment and wrapping the elastic cord around said user's foot that is not in said foot attachment, the user then lies on the user's back with the user's knees elevated, the user pushes the user's legs apart thereby creating a stronger tension in said cord, the user holds it for a time period and then the user brings the legs back together in a rest position thereby decreasing the tension in the cord.

4. A method of exercising the buttock of a user comprising the user employing an exercise device comprising:

a) at least one elastic cord having two ends, b) at least one foot attachment, said foot attachment means is of a size and shape to allow a user to insert a foot into said foot attachment and c) at least one attachment means which attaches said foot attachment means to said elastic cord and said user places each foot inside a foot attachment and the device further comprises a neck piece, and the user places said neck piece over the user's neck, the user stands in a completely vertical position, the user stands on said user's toes, raising the user's heels off the ground, thereby causing greater tension in the cord to be formed, the user then can lower the heels and rotate the toes inwardly then raise the user's heels and hold it for a time period and the user can lower the heels and rotate the toes outwardly and hold it for a time period.

5. A method of exercising the buttock of a user comprising the user employing an exercise device comprising:

a) at least one elastic cord having two ends, b) at least one foot attachment, said foot attachment means is of a size and shape to allow a user to insert a foot into said foot attachment and c) at least one attachment means which attaches said foot attachment means to said elastic cord and said user inserts one foot in said foot attachment and wrapping said elastic cord around the ankle of the user that is not in said foot attachments the user then stands on the user's toes having the toes face inwardly and the user raises the heels off the ground surface, the user then places the user's heels on the ground thereby decreasing the tension in the cord, then the user pushes the user's toes outwardly and raises the heels off the ground surface thereby creating greater tension on the cord and then the user places the user's heels back on the ground surface.

* * * * *